United States Patent [19]

Dremann

[11] 4,171,215

[45] Oct. 16, 1979

[54] ALLOYING ADDITION FOR ALLOYING MANGANESE TO ALUMINUM

[75] Inventor: Charles E. Dremann, Phoenixville, Pa.

[73] Assignee: Foote Mineral Company, Exton, Pa.

[21] Appl. No.: 921,166

[22] Filed: Jul. 3, 1978

[51] Int. Cl.[2] ..... C22C 22/00; B22D 23/08

[52] U.S. Cl. ..... 75/0.5 B; 75/134 M; 75/138; 75/255

[58] Field of Search ..... 75/0.5 C, 255, 134 M, 75/138, 0.5 B; 264/11

[56] References Cited

U.S. PATENT DOCUMENTS

| | | | |
|---|---|---|---|
| 3,119,688 | 1/1964 | Rodgers et al. | 75/134 M |
| 3,591,369 | 7/1971 | Tuthill | 75/138 |
| 3,592,637 | 7/1971 | Brown et al. | 75/138 |
| 3,788,839 | 1/1974 | Faunce | 75/138 |
| 3,793,007 | 2/1974 | Kline et al. | 75/134 M |
| 3,935,004 | 1/1976 | Faunce | 75/138 |
| 3,941,588 | 3/1976 | Dremann | 75/138 |

OTHER PUBLICATIONS

Sully, A. H.; Manganese; Academic Press Inc., 1955, pp. 124–129.

*Primary Examiner*—W. Stallard
*Attorney, Agent, or Firm*—Howson and Howson

[57] ABSTRACT

Manganese is alloyed into aluminum using a solid compact prepared by blending finely divided particles comprising beta manganese with aluminum particles and then compacting the mixture into a readily useable form such as a briquette. The resultant briquette provides rapid dissolution of the beta manganese in the aluminum and improved manganese recoveries. The beta manganese may be prepared by heating manganese to 1305°–1990° F. followed by water quenching and crushing to obtain a product of controlled particle size having a reduced percentage of fines.

10 Claims, No Drawings

ALLOYING ADDITION FOR ALLOYING MANGANESE TO ALUMINUM

FIELD OF THE INVENTION

This invention relates to a process and composition for the incorporation of manganese into aluminum. A compacted mixture of particulate beta manganese and aluminum is introduced directly into a molten aluminum bath whereby rapid and complete solution of the manganese in aluminum takes place with improved manganese recovery.

BACKGROUND OF THE INVENTION

Aluminum containing small amounts of manganese constitute a class of known alloys having the corrosion resistance of aluminum with higher strength. The addition of manganese metal to molten aluminum to provide final alloys of this type is generally unsatisfactory because of the slow rate of dissolution thereof in the molten aluminum and poor manganese recoveries. As a result, to a considerable extent manganese has been added to molten aluminum, to provide the final alloy, in the form of a master aluminum-manganese alloy containing much higher (up to 30%) manganese contents. However, such alloys are costly and/or inconvenient to produce and handle.

A more recent method involves pre-mixing of finely divided normally alpha manganese containing particles with finely divided aluminum particles and compacting the mixture into a pellet or briquette. By reason of the presence of aluminum, which is commonly referred to as a "promoter material", the manganese dissolves more readily than the manganese metal, for when such a compacted mixture is added to a bath of molten aluminum the lower melting portion of the mixture, i.e. the aluminum, melts and thus assists in the dispersion of the remaining mass of manganese. The speed at which the manganese then dissolves in the molten aluminum is a function of its particle size, surface area, and bath conditions, such as temperature and amount of agitation. Nevertheless, at typical operating temperatures for aluminum baths in commercial operations, e.g. temperatures of about 1280° F. to about 1500° F., the solubility rate of such compacts is not as rapid as desired.

Because of the disadvantages of the current state of the art, it remains desirable to provide a manganese alloying additive and process for incorporating manganese into aluminum which will be capable of dissolving in the molten bath of aluminum in short periods of time with high recoveries of manganese in the final alloy.

It is a principal object of the present invention to provide a method for adding manganese to molten aluminum whereby the rate of solution of the manganese is markedly faster than heretofore.

It is another principal object of the present invention to provide a method for converting manganese into a physical form which enhances its rate of dissolution in molten aluminum.

A further principal object of this invention is to provide a mangangese alloying additive for addition to molten aluminum which has a fast rate of dissolution in the molten aluminum.

Still another principal object of the invention is to provide a novel method for producing manganese metal having a controlled particle size and a reduced fines content.

Other objects of the invention will become further apparent from the following specification and claims.

SUMMARY OF THE INVENTION

Electrolytic manganese, which is normally alpha manganese, has heretofore been used in aluminum-manganese compacts for addition to molten aluminum for the purpose of forming final aluminum alloys containing manganese. When alpha manganese is heated to temperatures on the order of 1305°–1990° F., followed by water quenching, conversion to the beta phase takes place. It was discovered that if the alpha manganese presently used in manganese alloying additives were replaced by beta manganese, such additives dissolve considerably more rapidly and completely in a bath of molten aluminum and recoveries of manganese are considerably enhanced.

DESCRIPTION OF PREFERRED EMBODIMENTS

In accordance with this invention, low oxygen electrolytic manganese chip having the normal alpha phase (allotropic form) is heated to a temperature of about 1305° to about 1990° F., and then rapidly quenched to ambient temperatures, as for example in water, whereby the manganese is converted to the beta phase. Preferably, the manganese chip is heated to a temperature of about 1400° to about 1600° F. and quenched in water.

The resulting beta manganese is then crushed to produce a 30 mesh×down powder. Advantageously the powder has a relatively uniform or controlled particle size and contains less than about 50% by weight of −325 mesh material. By way of contrast when alpha manganese chip is similarly crushed, the resulting powder contains on the order of 75%–325 mesh particles. Such reduction in the fines content of beta manganese powder produced according to this invention was unexpected since heat treatments do not ordinarily have a significant effect on the particle size of the crushed metal. By reason of its more uniform particle size, beta manganese powder is particularly suitable not only for forming manganese-aluminum compacts according to this invention as more fully described hereinbelow, but also in making welding rods where particle size specifications for manganese powder are quite rigid.

The beta manganese after being crushed will generally have a particle size distribution similar to that shown in Table I.

Table I

| mm. (mesh) | % retained on or between sieves |
|---|---|
| 0.420 (40) | 7.8 |
| 0.297 (50) | 19.4 |
| 0.210 (70) | 19.8 |
| 0.149 (100) | 13.8 |
| 0.105 (140) | 9.4 |
| 0.074 (200) | 7.5 |
| 0.044 (325) | 7.8 |
| −0.044 (325) | 14.5 |

Although it is generally convenient to produce beta manganese by means of the above described heat treatment, the beta structure can also be obtained by controlled cooling of molten manganese.

In the alloying additions according to this invention it is generally preferable to have the beta manganese present in the form of the metal per se. However, the beta manganese can also be in the form of an alloy of manganese and aluminum. In this regard, it is known that when manganese is present in such an alloy in an amount of from 75 to about 98 percent, the manganese is in the beta form. A particularly preferred alloy for use in making the compacts comprises about 95 percent manganese and 5 percent aluminum.

The aluminum constituent of the compacts should, like the beta manganese constituent, be substantially pure, i.e. comprise at least 95 percent aluminum, and also should be finely divided. Aluminum powders where the average particle size is 40 mesh×down are particularly suitable for forming the compacts of this invention.

A mixture of the beta manganese and aluminum particles is then prepared and the mixture is compacted to form coherent briquettes or pellets. The pellets or briquettes preferably have sufficient density so that they sink of their own weight in the bath or molten aluminum. There is commercially available a variety of pelletizing and briquetting equipment which may be used to form the compacts of this invention.

Ordinarily the compacts will contain from about 50 to about 90 percent beta manganese and from about 10 to about 50 percent aluminum, said percentages being by weight based on the total composition of the compact. Preferably the compacts contain from about 70 to about 80 percent beta manganese and from about 20 to about 30 percent aluminum. When the beta manganese is present in the form of an alloy of aluminum and manganese, at least 10 percent of the compact should comprise powdered aluminum.

In use, the compacts are added to the molten aluminum which generally is at a temperature in the range of about 1280° to about 1500° F. After addition of the compacts the bath should be stirred, at least periodically. Generally compacts in an amount of from about 15 to about 35 pounds per ton of aluminum may be used to obtain desirable aluminum alloys of improved strength.

The compacts may be of any shape, but should not be so large in dimensions as to interfere with rapid dissolution of the manganese. Thus, suitable compacts are pillow-shaped briquettes having a thickness not exceeding about ½ inch and a length and width on the order of from about ½ to about 2½ inches.

To more particularly illustrate the present invention various tests were performed and the data obtained are shown in the following examples.

EXAMPLE 1

Separate batches of low oxygen electrolytic manganese chip having the normal alpha phase, one bath having a sulfur content of 0.03 percent and the other of 0.07 percent, were heated to 1000° F. to effect hydrogen removal, air cooled to ambient temperatures, and ground into a powder having a particle size of 30 mesh×down. X-ray diffraction patterns of the powder from each batch thus prepared showed the manganese to have the alpha structure.

77 parts by weight of the manganese powder from each batch were mixed with 23 parts of an aluminum powder of high purity having a particle size of 40 mesh×down, and the mixtures were compacted into coherent briquettes 1 inch in length by ⅝ inch in width and ⅜ inch in thickness. Each briquette weighed approximately 17 grams.

EXAMPLE 2

The procedure of Example 1 was repeated with the exception that prior to air cooling, the manganese chip in each batch was heated to 1500° F. X-ray diffraction patterns of the powder from each batch showed the manganese to be alpha manganese. Briquettes similar to those of Example 1, each containing 77 parts manganese from one or the other of the two batches and 23 parts aluminum, were prepared.

EXAMPLE 3

The procedure of Example 1 was repeated with the exception that the manganese chip in each batch was heated to 1000° F. followed by water quench. X-ray diffraction patterns of the manganese powder after crushing for each batch showed it to have the alpha phase. Briquettes similar to those of Example 1, containing 77 parts manganese from one or the other of the two batches and 23 parts aluminum were prepared.

EXAMPLE 4

The procedure of Example 1 was repeated with the exception that the manganese chip in each batch was heated to 1500° F. followed by water quench. X-ray diffraction patterns of the manganese powder from each batch showed the manganese to have the beta phase. Briquettes similar to those of Example 1, containing 77 parts manganese from one or the other of the two batches and 23 parts aluminum, were prepared.

EXAMPLE 5

Briquettes of Examples 1, 2, 3 and 4 were added to separate 10 kilogram batches of molten aluminum. The number of the particular briquettes added in each instance was nine. One-half of the baths were at 1300° F. while the other half were at 1400° F. Briquettes similar to those of Examples 1 to 4 containing untreated manganese were also introduced to molten aluminum baths as a control. Solution rate of the respective briquettes was measured by determining manganese recovery in weight percent 15 minutes subsequent to introduction of the briquettes into the molten aluminum. The results are set forth in Table II, below:

Table II

| | Mn Recovery (%) at 15 Minutes | | | |
|---|---|---|---|---|
| | 1300° F. | | 1400° F. | |
| Example | A* | B** | A* | B** |
| 1 | 93.4 | 93.0 | 87.6 | 95.4 |
| 2 | 96.7 | 93.4 | 93.8 | 94.0 |
| 3 | 97.2 | 95.4 | 93.9 | 95.8 |
| 4 | 96.9 | 95.8 | 100.5 | 97.3 |
| Control | 86.2 | 90.4 | 78.6 | 83.7 |

*Manganese containing 0.03% sulfur.
**Manganese containing 0.07% sulfur.

The results, presented in Table II, for 1300° F. and 1400° F. melt temperatures, show that increased rate of solution and improved manganese recoveries are obtain with manganese-aluminum briquettes according to this invention containing beta manganese.

EXAMPLE 6

Manganese-aluminum briquettes were prepared according to Examples 2 and 4. In addition, briquettes of the same composition (77% manganese/23% aluminum) in which the manganese had not been subject to any heat treatment were prepared and used as a control.

Each type of briquette was added alone to 400 pound aluminum melts at 1300° F. After addition of the briquettes each melt was stirred continuously for 1 minute from 2 to 3 minutes after addition and again from 7 to 8 and 12 to 13 minutes after addition. Three samples of the aluminum were taken from each melt at about 5, 10 and 15 minutes after addition of the briquettes. Solution rate, in terms of manganese recovery, were determined by analysis of the samples taken at 5, 10 and 15 minutes after briquette addition and the results are given in Table III, below:

Table III

| Sample | Manganese Recovery (%) | | |
|---|---|---|---|
| | 5 mins. | 10 mins. | 15 mins. |
| Control | 73 | 80 | 86 |
| 1500° F., air cool (αmanganese) | 74 | 97 | 100 |
| 1500° F., water quench (β manganese) | 87 | 100 | 100 |

The data in Table III show the improvements in terms of rate of solution of manganese and manganese recovery made possible by the present invention.

EXAMPLE 7

An alloy of manganese and aluminum comprising 95 percent, by weight manganese was prepared by melting low oxygen manganese and aluminum in a magnesium oxide crucible using a cryolite flux, and cooling the resulting alloy to room temperature. In such an alloy the manganese is in the beta form.

The alloy was crushed to 30 mesh×down and 770 grams thereof was mixed with an atomized aluminum powder having a particle size of 40 mesh×down. The mixture was compacted into coherent briquettes 1 inch in length by ⅝ inch in width and ⅜ inches in thickness. Each briquette weighed approximately 17 grams.

EXAMPLE 8

The procedure of Example 7 was repeated with the exception that 811 grams of the manganese-aluminum alloy was combined with 189 g. of the aluminum powder.

EXAMPLE 9

The procedure of Example 7 was repeated with the exception that 770 grams of alpha manganese were used in place of the manganese-aluminum alloy.

EXAMPLE 10

Briquettes of Examples 7, 8 and 9 were added to separate 10 kilogram batches of molten aluminum, one-half of which were at 1300° F. while the other half were at 1400° F. Solution rate of the respective briquettes was measured by determining manganese recovery in weight percent 15 minutes subsequent to introduction of the briquettes into the molten aluminum. The results are given in Table IV below:

Table IV

| Example | Ratio Mn/Al | Mn Recovery 1300° F. % | Mn Recovery 1400° F. % |
|---|---|---|---|
| 7 | 81/19 | 97.8 | 97.6 |
| 8 | 77/23 | 96.5 | 96.4 |
| 9* | 77/23 | 91.6 | 90.5 |

*Control

The results as given in Table IV show improved manganese recoveries are obtained using Mn-Al briquettes containing beta manganese in the form of a Mn-Al alloy, as compared to similar briquettes in which the manganese is alpha manganese.

I claim:

1. An alloying addition for alloying manganese with aluminum which comprises a mixture of finely divided particles of aluminum and beta manganese, said beta manganese being present as manganese metal or in the form of a manganese-aluminum alloy comprising from about 75 to about 98 percent, by weight, manganese, said alloying addition comprising from about 50 to about 90 percent, by weight, of beta manganese and from about 10 to about 50 percent aluminum, at least about 10 percent by weight of the total composition comprising aluminum powder.

2. An alloying addition according to claim 1 in the form of a solid compact comprised of a mixture of finely divided beta manganese and aluminum particles.

3. An alloying addition according to claim 2 comprising from about 70 to about 80 percent beta manganese and from about 20 to about 30 percent aluminum.

4. An alloying addition according to claim 3 comprising about 75 percent beta manganese and about 25 percent aluminum.

5. An alloying additive according to claim 1 in which said beta manganese is present as manganese metal.

6. An alloying additive according to claim 1 in which said beta manganese is present in the form of an alloy of beta manganese and aluminum.

7. An alloying addition according to claim 6 comprising at least about 25 percent aluminum powder.

8. A method for preparing manganese powder having a controlled particle size and a reduced fines content which comprises heating manganese to a temperature in the range of from about 1305° to about 1990° F., quenching the hot metal in water, and crushing the cooled metal.

9. The method according to claim 8 in which the manganese is heated to a temperature of from about 1400° to about 1600° F.

10. The method according to claim 9 in which said cooled metal is subjected to roll crushing.

* * * * *